US008978410B2

(12) United States Patent
Oh et al.

(10) Patent No.: US 8,978,410 B2
(45) Date of Patent: Mar. 17, 2015

(54) REFRIGERATING SYSTEM HAVING TWO EVAPORATORS PERFORMING HEAT EXCHANGE

(75) Inventors: Min-Kyu Oh, Seoul (KR); Gye-Young Song, Seoul (KR); Nam-Gyo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 835 days.

(21) Appl. No.: 12/601,145

(22) PCT Filed: Dec. 14, 2007

(86) PCT No.: PCT/KR2007/006549

§ 371 (c)(1),
(2), (4) Date: Nov. 20, 2009

(87) PCT Pub. No.: WO2008/147007

PCT Pub. Date: Dec. 4, 2008

(65) Prior Publication Data

US 2010/0192622 A1 Aug. 5, 2010

(30) Foreign Application Priority Data

May 25, 2007 (KR) ..... 10-2007-0051102

(51) Int. Cl.
*F25B 41/00* (2006.01)
*F25B 1/00* (2006.01)
(Continued)

(52) U.S. Cl.
CPC ..... *F25D 11/022* (2013.01); *F25B 2600/2507* (2013.01); *F25D 17/065* (2013.01)
USPC ..... 62/513; 62/498; 62/515

(58) Field of Classification Search
CPC ..... F25D 11/022; F25D 11/02; F25D 17/065; F25B 2600/2507; F25B 5/02; F25B 39/028
USPC ..... 62/498, 513, 515
See application file for complete search history.

(56) References Cited

U.S. PATENT DOCUMENTS 2,581,044 A * 1/1952 Ratcliff ..... 62/149
3,505,810 A * 4/1970 Mamiya ..... 60/673
(Continued)

FOREIGN PATENT DOCUMENTS

EP 0 178 226 4/1986
EP 178226 A1 * 4/1986 ..... F25D 11/02
(Continued)

OTHER PUBLICATIONS

International Search Report dated Mar. 19, 2008.
(Continued)

*Primary Examiner* — Frantz Jules
*Assistant Examiner* — Joseph Trpisovsky
(74) *Attorney, Agent, or Firm* — Ked & Associates, LLP

(57) ABSTRACT

A refrigerating system is provided in which a heat exchanging unit performs heat exchange between first and second evaporators, so that the first and second evaporators have similar temperatures, and so that an additional "pump-down" operation may be avoided, thereby reducing compressor losses due to discharge occurrences. Since the additional pump-down operation may be avoided, power consumption may be reduced, and reliability and efficiency of the system may be enhanced. Additionally, a backflow preventing unit for preventing backflow of refrigerant in an evaporator may not be required, thus further reducing fabrication cost and complexity.

14 Claims, 6 Drawing Sheets

(51) Int. Cl.

| | |
|---|---|
| ***F25B 39/02*** | (2006.01) |
| ***F25D 11/02*** | (2006.01) |
| *F25D 17/06* | (2006.01) |

(56) References Cited

U.S. PATENT DOCUMENTS

| | | | | |
|---|---|---|---|---|
| 4,918,936 | A * | 4/1990 | Sakamoto | 62/117 |
| 2002/0043073 | A1* | 4/2002 | Park et al. | 62/231 |
| 2005/0198997 | A1* | 9/2005 | Bush | 62/513 |
| 2006/0042310 | A1* | 3/2006 | Son | 62/513 |
| 2006/0130518 | A1* | 6/2006 | Kang et al. | 62/525 |

FOREIGN PATENT DOCUMENTS

| | | |
|---|---|---|
| JP | 2001-082851 | 3/2001 |
| KR | 10-2004-0000963 | 1/2004 |
| KR | 10-2004-0003876 | 1/2004 |
| KR | 10-0510647 | 1/2004 |

OTHER PUBLICATIONS

Korean Office Action dated May 16, 1013.

* cited by examiner

REFRIGERATING SYSTEM HAVING TWO EVAPORATORS PERFORMING HEAT EXCHANGE

TECHNICAL FIELD

The present invention relates to a refrigerating system, and more particularly, to a refrigerating system capable of independently cooling a plurality of cooling spaces by using a plurality of evaporators provided at the respective cooling spaces.

BACKGROUND ART

Generally, a refrigerating system includes a compressor, a condenser, a drier, an expansion device, and an evaporator connected to one another by refrigerant pipes so as to circulate a refrigerant. While passing through the compressor, the condenser, the expansion device, and the evaporator, a refrigerant is compressed, condensed, evaporated, and expanded thereby to perform a cooling operation.

In the conventional art, one evaporator is provided, and a process for cooling a plurality of cooling spaces is performed by circulating cool air generated from the evaporator. However, recently, a refrigerating system for independently cooling a plurality of cooling spaces by using a plurality of evaporators is presented. The refrigerating system is applied to a refrigerator.

According to the refrigerator, a refrigerant is supplied to one of a plurality of evaporators thus to perform a cooling operation for a cooling space having the evaporator. Here, if the cooling space satisfies a condition preset by a controller, the refrigerant is supplied to another cooling space thus to perform a cooling operation.

However, the refrigerating system for independently cooling a plurality of cooling spaces by using a plurality of evaporators has the following problems. After one cooling space is cooled by one evaporator provided thereat, another cooling space is cooled by another evaporator provided thereat. Here, since the respective evaporators have different outlet temperatures from each other, a refrigerant remaining at the one evaporator is not sucked to the compressor at the time of a cooling operation. Accordingly, required is a 'pump-down' operation for collecting a refrigerant remaining at an evaporator to a compressor by operating the compressor under a state that refrigerant supply to a plurality of evaporators is blocked.

In the refrigerating system for performing a cooling operation by sequentially introducing a refrigerant into a plurality of evaporators, when a refrigerant remains at the evaporators, a cooling operation is performed with a refrigerant deficient by the remaining amount. Accordingly, the entire cooling operation is degraded. The 'pump-down' operation is performed to prevent the entire cooling capability from being degraded.

Especially, the 'pump-down' operation is required at the time of converting a cooling operation from a freezing chamber to a refrigerating chamber.

However, the conventional 'pump-down' technique has the following problems. First, a refrigerant remaining at the evaporators is collected to the compressor by operating the compressor under a state that refrigerant supply to the evaporators is blocked. Accordingly, as the 'pump-down' operation is performed, the compressor may have a lowered suction pressure and discharge occurrence. As a result, the compressor may have damage or a loss.

Second, in order to collect a remaining refrigerant to the compressor, a suction pressure of the compressor has to be excessively lowered. Accordingly, high power is required to operate the compressor, thereby degrading the efficiency of the refrigerating system.

Third, as the 'pump-down' operation is performed, a suction pressure and an outlet pressure of the compressor are lowered, and thus the collected refrigerant may backflow to the evaporator. To solve the problem, a backflow preventing unit is provided between a compressor inlet and an evaporator outlet, thereby increasing the fabrication cost.

DISCLOSURE OF THE INVENTION

Therefore, it is an object of the present invention to provide a refrigerating system capable of sequentially cooling a plurality of cooling spaces by using evaporators provided at the respective cooling spaces, and collecting a refrigerant without an additional pump-down operation.

To achieve these objects, there is provided a refrigerating system, comprising: a first cycle for circulating a refrigerant discharged from a compressor through a first evaporator provided to cool a first cooling space; a second cycle for circulating the refrigerant through a second evaporator provided to cool a second cooling space; a refrigerant supply means for supplying a refrigerant to one of the first cycle and the second cycle; and a heat exchanging unit for performing heat exchange between the first evaporator and the second evaporator.

MODES FOR CARRYING OUT THE PREFERRED EMBODIMENTS

Reference will now be made in detail to the preferred embodiments of the present invention, examples of which are illustrated in the accompanying drawings.

Hereinafter, a refrigerating system according to a first embodiment of the present invention will be explained in more detail.

In the refrigerating system according to the present invention, a plurality of evaporators for respectively cooling a plurality of cooling spaces are provided. The present invention is not limited to a refrigerator having a plurality of cooling spaces such as first, second and third cooling spaces, but can be applied to various types of refrigerating devices and air conditioners.

For the understanding of those skilled in the art, the present invention discloses a refrigerating system and a refrigerator having the same. Here, the refrigerating system selectively operates a first cycle to circulate a refrigerant discharged from a compressor through a first evaporator provided to cool a first cooling space, or a second cycle to circulate the refrigerant through a second evaporator provided to cool a second cooling space.

Figure 1:
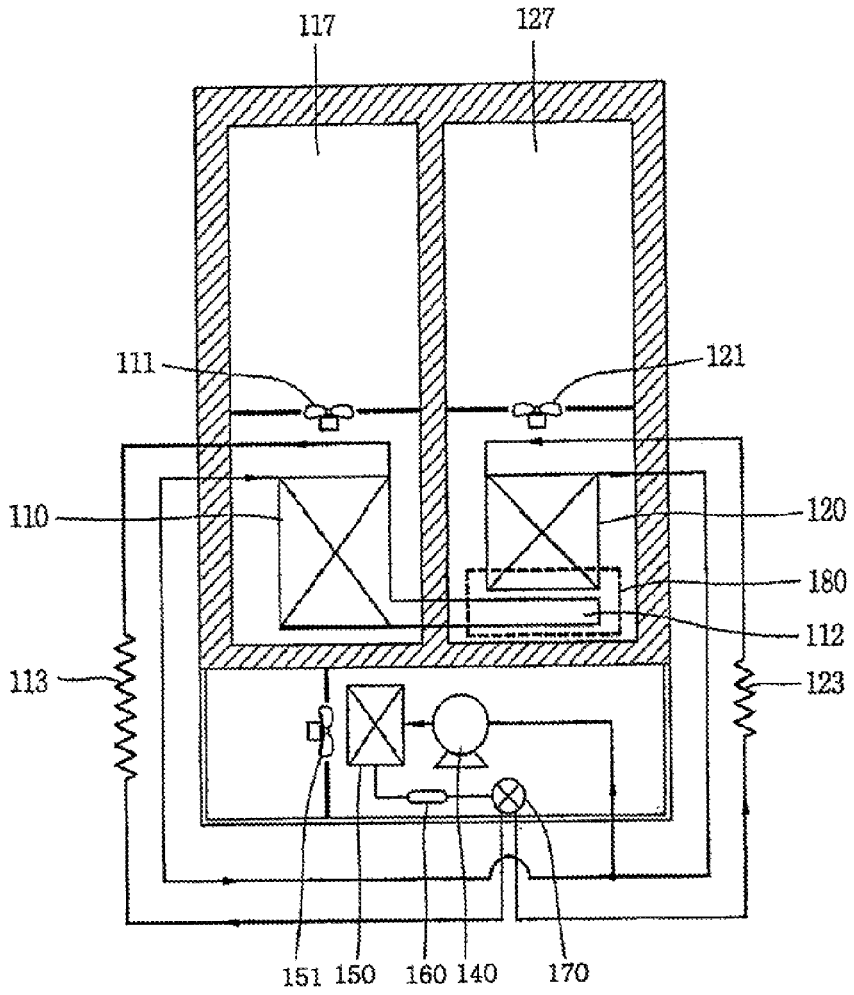
FIG. 1 is a schematic view showing a refrigerating system according to a first embodiment of the present invention.

FIG. 1 is a schematic view showing a refrigerating system according to a first embodiment of the present invention.

Referring to FIG. 1, the refrigerating system according to a first embodiment of the present invention comprises a compressor 140 for compressing a refrigerant into a high temperature and high pressure gaseous refrigerant, a condenser 150 for heat-exchanging the gaseous refrigerant compressed by the compressor 140 with ambient air thereby condensing it into a middle temperature and high pressure liquid refrigerant, a drier 160 for removing moisture and impurities included in the condensed refrigerant, a refrigerant supply means 170 for supplying the refrigerant having passed through the drier 160 to an evaporator provided at a cooling space to be cooled, expansion devices 113, 123 for expanding and decompressing the refrigerant introduced by the refrigerant supply means 170 into a low temperature and low pressure liquid refrigerant, and first and second evaporators 110, 120 for heat-exchanging the liquid refrigerant having passed through the expansion devices 113, 123 with ambient air thereby evaporating it as a low temperature and low pressure gaseous refrigerant, and cooling ambient air.

In correspondence to the first and second evaporators 110, 120, first and second blowing fans 111, 121 for circulating cool air to each cooling space from the first and second evaporators 110, 120 are provided.

Here, the refrigerant supply means 170 may be implemented as a three-way valve for supplying the refrigerant having passed through the drier 160 to one of the first and second evaporators 110, 120. The refrigerant supply means 170 may be implemented to supply a refrigerant to one of the first and second evaporators 110, 120 by turning on/off an open/close valve and flowing a refrigerant on one of the first and second evaporators 110, 120.

The refrigerating system according to the first embodiment of the present invention comprises a heat exchanging unit 180 for performing heat exchange between the first and second evaporators 110, 120.

The heat exchanging unit 180 may be formed such that a protrusion 112 formed as a part of the first evaporator 110 is extended is positioned near the second evaporator 120.

Preferably, the protrusion 112 is formed as a part of an outlet of the first evaporator 110 is extended.

Generally, a 'pump-down' operation is performed so as to collect an outlet side refrigerant of one evaporator having a lower temperature than other one or more evaporators. The outlet of the first evaporator 110 is heat-exchanged with the second evaporator 120 thus to have an increased temperature. Accordingly, the outlet side refrigerant of the first evaporator 110 is effectively collected, Preferably, the protrusion 112 is provided with a refrigerant pipe through which a refrigerant flows to the first evaporator 110.

Preferably, the refrigerant pipe of the protrusion 112 is extended from an outlet side refrigerant pipe of the first evaporator 110 so as to pass the refrigerant having been heat-exchanged with air of the first cooling space 117 via the first evaporator 110.

Preferably, the second evaporator 120 is positioned such that an outlet thereof is adjacent to the protrusion 112.

Since an outlet side refrigerant of the second evaporator 120 has a higher temperature than an inlet side refrigerant, it is effectively heat-exchanged with the protrusion 112.

The second evaporator 120 and the protrusion 112 may be provided to be adjacent to each other with a gap wide enough to generate heat exchange therebetween. The second evaporator 120 and the protrusion 112 may be provided to come in contact with each other.

In the above configuration, a temperature difference between each outlet side refrigerant of the first and second evaporators 110, 120 is small, thereby to collect remaining refrigerant without a 'pump-down' operation.

Preferably, one refrigerator having a larger load between the first and second evaporators 110, 120 is referred to as the first evaporator 110, and another having a smaller load between the first and second evaporators 110, 120 is referred to as the second evaporator 120.

Preferably, one evaporator provided to cool a freezing chamber of a refrigerator is referred to as the first evaporator 110, and another evaporator provided to cool a chilling chamber of the refrigerator is referred to as the second evaporator 120.

Referring to FIG. 1, reference numeral 151 denotes a condensing fan for discharging heat from the condenser 150.

Hereinafter, the operation of the refrigerating system according to the first embodiment of the present invention will be explained.

First, refrigerant compressed by the compressor 140 is heat-exchanged with external air via the condenser 150 thus to be condensed. Then, the condensed refrigerant is introduced into the drier 160 connected to the condenser 150 through a pipe. Here, as moisture and impurities included in the condensed refrigerant are filtered by the drier, pure refrigerant is obtained. Then, the refrigerant having passed through the drier 160 is introduced into the expansion device 113 by the refrigerant supplying unit 170, is introduced into the first evaporator 110 thus to cool the first cooling space 117, and is fed back to the compressor 140. Once the first cooling space 117 has a temperature preset by a user, a refrigerant is supplied to the expansion device 123 and the second evaporator 120 by the refrigerant supply means 170 thus to start to cool the second cooling space 127. Here, a refrigerant having not been collected to the compressor 140 remains at the first evaporator 110. The refrigerant remaining at the first evaporator 110 is heat-exchanged with a refrigerant passing through the second evaporator 120 by the heat exchanging unit 180. Accordingly, a temperature difference between the refrigerant remaining at the first evaporator 110 and the refrigerant remaining at the second evaporator 120 becomes small, thereby collecting the refrigerant remaining at the first evaporator 110 to the compressor 140. Therefore, an additional 'pump-down' operation is not required.

Hereinafter, the operation of the refrigerating system according to a second embodiment of the present invention will be explained. Explanation for the same parts as those of the first embodiment will be omitted.

Figure 2:
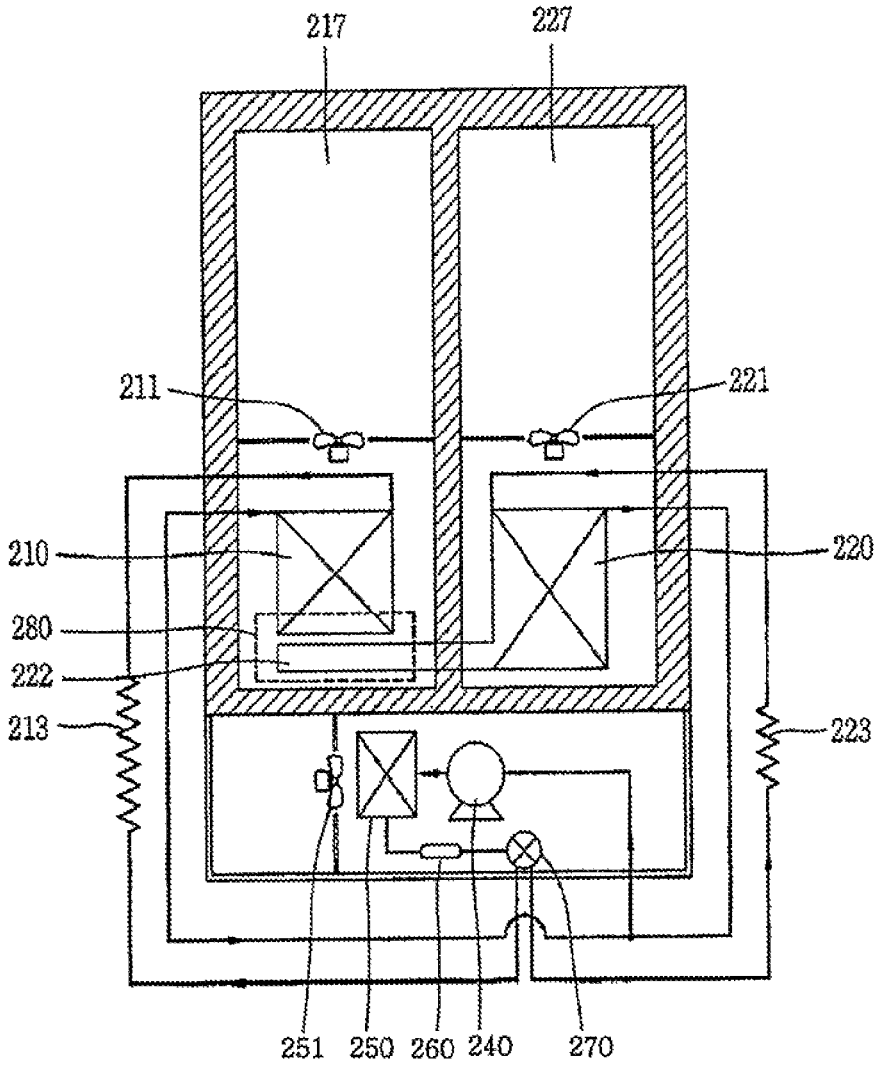
FIG. 2 is a schematic view showing a refrigerating system according to a second embodiment of the present invention.

FIG. 2 is a schematic view showing a refrigerating system according to a second embodiment of the present invention.

Referring to FIG. 2, the refrigerating system according to a second embodiment of the present invention comprises a first evaporator 210, a second evaporator 220, and a heat exchanging unit 280 for performing heat exchange between the first and second evaporators 210, 220.

The heat exchanging unit 280 may be formed such that a protrusion 222 formed as a part of the second evaporator 220 is extended is positioned near the first evaporator 210.

Preferably, the heat exchanging unit 280 is formed such that an outlet of the first evaporator 210 is positioned near the protrusion 222.

The reason is in order to increase a temperature of an outlet side refrigerant of the first evaporator 210 thereby to effectively collect the refrigerant.

The protrusion 222 is provided with a refrigerant pipe through which a refrigerant flows to the second evaporator 220.

Preferably, the refrigerant pipe of the protrusion 222 is formed as an outlet side refrigerant pipe of the second evaporator 220 is extended, thereby passing a refrigerant having been heat-exchanged with air of the second cooling space 227.

In the above configuration, the refrigerant flowing on the protrusion 222 has a temperature higher than that of an inlet side refrigerant of the second evaporator 220. Accordingly, the refrigerant passing through the first evaporator 210 that performs heat-exchange with the second evaporator 220 has a higher temperature, thereby being effectively collected.

In the refrigerating system according to the second embodiment of the present invention, a refrigerant remaining at the first evaporator 210 is heat-exchanged with a refrigerant passing through the second evaporator 220 by the heat exchanging unit 280. By the heat-exchange, a temperature difference between the refrigerant remaining at the first evaporator 210 and the refrigerant passing through the second evaporator 220 becomes small. Accordingly, the refrigerant remaining at the first evaporator 210 is collected to the compressor 240, thereby requiring no 'pump-down' operation.

Hereinafter, the operation of the refrigerating system according to a third embodiment of the present invention will be explained. Explanation for the same parts as those of the first embodiment will be omitted.

Figure 3:
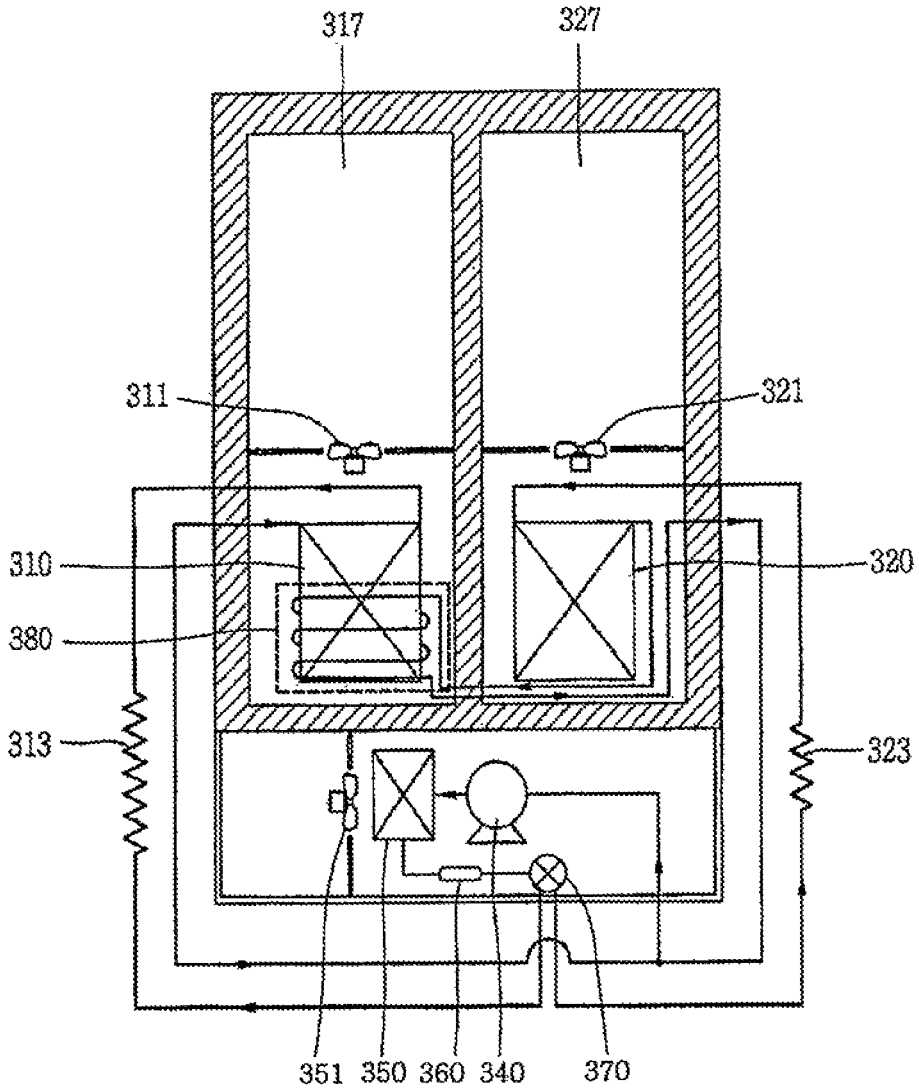
FIG. 3 is a schematic view showing a refrigerating system according to a third embodiment of the present invention.

FIG. 3 is a schematic view showing a refrigerating system according to a third embodiment of the present invention.

Referring to FIG. 3, the refrigerating system according to a third embodiment of the present invention comprises a first evaporator 310, a second evaporator 320, and a heat exchanging unit 380 for performing heat exchange between the first and second evaporators 310, 320.

The heat exchanging unit 380 may be formed such that an outlet side refrigerant pipe of the second evaporator 320 winds the first evaporator 310 one or more times.

Here, the outlet side refrigerant pipe of the second evaporator 320 may wind an outlet of the first evaporator 310. In order to enhance heat-exchange efficiency, heat radiating fins of the first evaporator 310 may be formed to contact the outlet side refrigerant pipe of the second evaporator.

In the refrigerating system according to the third embodiment of the present invention, a refrigerant remaining at the first evaporator 310 is heat-exchanged with a refrigerant passing through the second evaporator 320 by the heat exchanging unit 380. By the heat-exchange, a temperature difference between the refrigerant remaining at the first evaporator 310 and the refrigerant passing through the second evaporator 320 becomes small. Accordingly, the refrigerant remaining at the first evaporator 310 is collected to the compressor 340, thereby requiring no 'pump-down' operation.

Hereinafter, the operation of the refrigerating system according to a fourth embodiment of the present invention will be explained. Explanation for the same parts as those of the first embodiment will be omitted.

Figure 4:
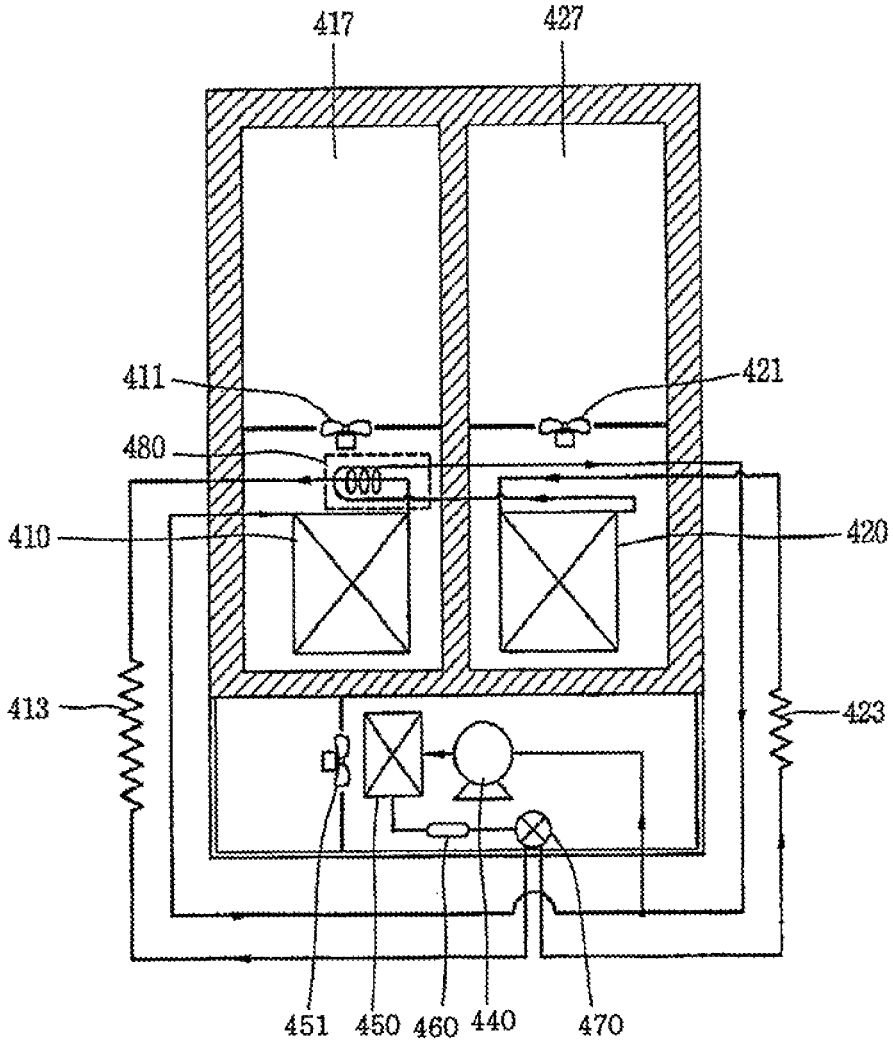
FIG. 4 is a schematic view showing a refrigerating system according to a fourth embodiment of the present invention.

FIG. 4 is a schematic view showing a refrigerating system according to a fourth embodiment of the present invention.

Referring to FIG. 4, the refrigerating system according to a fourth embodiment of the present invention comprises a first evaporator 410, a second evaporator 420, and a heat exchanging unit 480 for performing heat exchange between the first and second evaporators 410, 420.

The heat exchanging unit 480 may be formed such that an outlet side refrigerant pipe of the second evaporator 420 winds an outlet side refrigerant pipe of the first evaporator 410 one or more times.

In order to enhance heat-exchange efficiency, heat radiating fins that share the refrigerant pipes disposed at each outlet of the first and second evaporators 410, 420 may be provided.

In the refrigerating system according to the fourth embodiment of the present invention, a refrigerant remaining at the first evaporator 410 is heat-exchanged with a refrigerant passing through the second evaporator 420 by the heat exchanging unit 480. By the heat-exchange, a temperature difference between the refrigerant remaining at the first evaporator 410 and the refrigerant passing through the second evaporator 420 becomes small. Accordingly, the refrigerant remaining at the first evaporator 410 is collected to the compressor 440, thereby requiring no 'pump-down' operation.

Hereinafter, the operation of the refrigerating system according to a fifth embodiment of the present invention will be explained. Explanation for the same parts as those of the first embodiment will be omitted.

Figure 5:
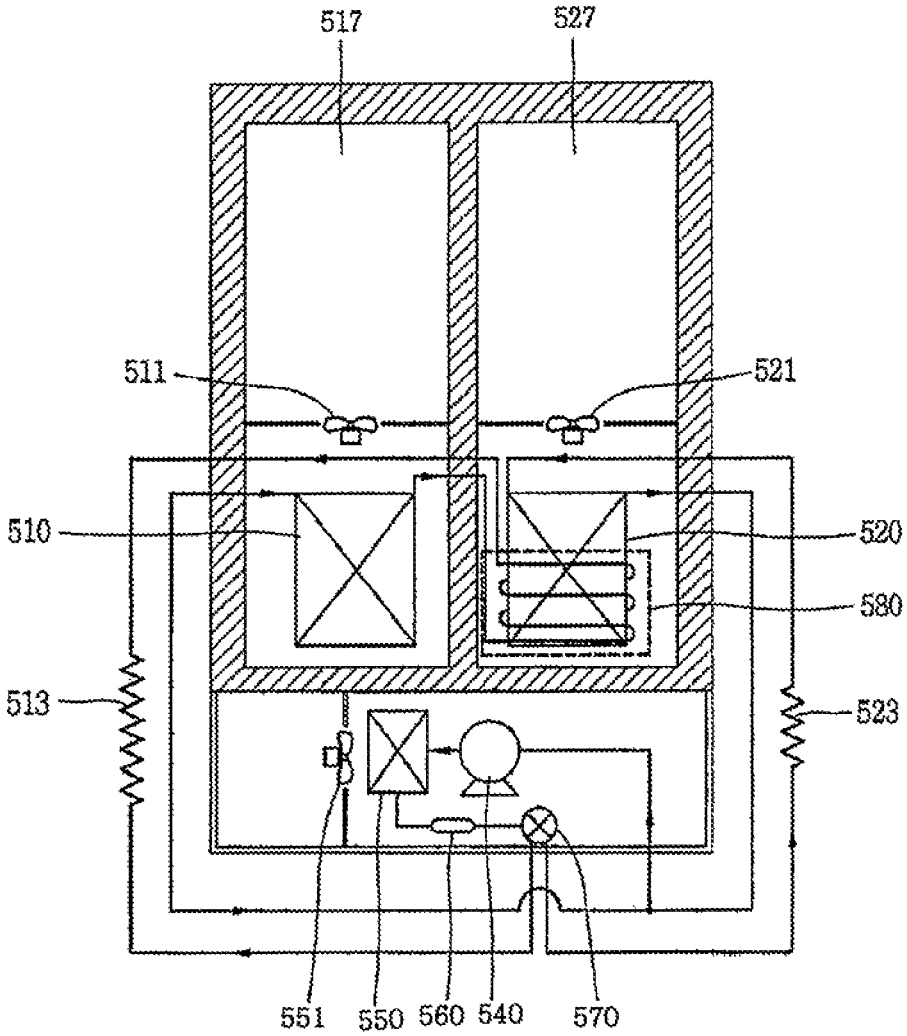
FIG. 5 is a schematic view showing a refrigerating system according to a fifth embodiment of the present invention.

FIG. 5 is a schematic view showing a refrigerating system according to a fifth embodiment of the present invention.

Referring to FIG. 5, the refrigerating system according to a fifth embodiment of the present invention comprises a first evaporator 510, a second evaporator 520, and a heat exchanging unit 580 for performing heat exchange between the first and second evaporators 510, 520.

The heat exchanging unit 580 may be formed such that an outlet side refrigerant pipe of the first evaporator 510 winds an outlet of the second evaporator 520 one or more times. In order to enhance heat-exchange efficiency, heat radiating fins of the second evaporator 520 may be formed to contact the outlet side refrigerant pipe of the first evaporator 510.

In the refrigerating system according to the fifth embodiment of the present invention, a refrigerant remaining at the first evaporator 510 is heat-exchanged with a refrigerant passing through the second evaporator 520 by the heat exchanging unit 580. By the heat-exchange, a temperature difference between the refrigerant remaining at the first evaporator 510 and the refrigerant passing through the second evaporator 520 becomes small. Accordingly, the refrigerant remaining at the first evaporator 510 is collected to the compressor 540, thereby requiring no 'pump-down' operation.

Hereinafter, the operation of the refrigerating system according to a sixth embodiment of the present invention will be explained. Explanation for the same parts as those of the first embodiment will be omitted.

Figure 6:
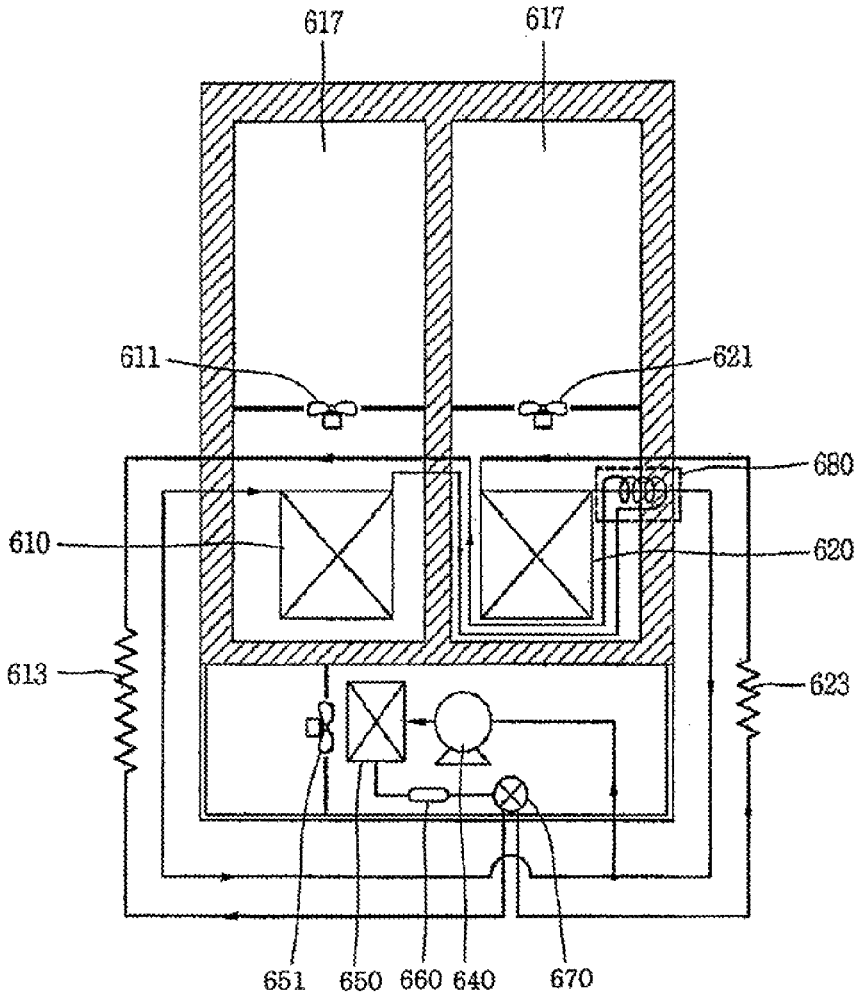
FIG. 6 is a schematic view showing a refrigerating system according to a sixth embodiment of the present invention.

FIG. 6 is a schematic view showing a refrigerating system according to a sixth embodiment of the present invention.

Referring to FIG. 6, the refrigerating system according to a sixth embodiment of the present invention comprises a first evaporator 610, a second evaporator 620, and a heat exchanging unit 680 for performing heat exchange between the first and second evaporators 610, 620.

The heat exchanging unit 680 may be formed such that an outlet side refrigerant pipe of the first evaporator 610 winds an outlet side refrigerant pipe of the second evaporator 620 one or more times.

In order to enhance heat-exchange efficiency, heat radiating fins that share the refrigerant pipes disposed at each outlet of the first and second evaporators 610, 620 may be provided.

In the refrigerating system according to the sixth embodiment of the present invention, a refrigerant remaining at the first evaporator 610 is heat-exchanged with a refrigerant passing through the second evaporator 620 by the heat exchanging unit 680. By the heat-exchange, a temperature difference between the refrigerant remaining at the first evaporator 610 and the refrigerant passing through the second evaporator 620 becomes small. Accordingly, the refrigerant remaining at the first evaporator 610 is collected to the compressor 640, thereby requiring no 'pump-down' operation.

The refrigerating system according to the present invention has the following advantages.

First, heat exchange is performed between the first and second evaporators by the heat exchanging unit. Accordingly, the first and second evaporators have temperatures similar to each other, thereby requiring no additional 'pump-down' operation.

Second, the compressor does not have a discharge occurrence owing to no additional 'pump-down' operation, thereby having no loss and an enhanced reliability.

Third, since no additional pump-down operation is required, power consumption for operating the compressor so as to collect a remaining refrigerant is reduced. Accordingly, the efficiency of the refrigerating system is enhanced.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A refrigerating system for providing cooling to a plurality of cooling spaces, the plurality of cooling spaces comprising a freezing chamber to maintain food items in a frozen state and a refrigerating chamber to maintain food items in a refrigerated state, the refrigerating system comprising:

a first cycle for circulating a refrigerant discharged from a compressor through a first evaporator disposed in the freezing chamber, wherein the first evaporator is configured to supply cooling air to the freezing chamber;

a second cycle, independent from the first cycle, for circulating the refrigerant through a second evaporator disposed in the refrigerating chamber, wherein the second evaporator is configured to supply cooling air to the refrigerating chamber;

a refrigerant supply device disposed downstream of a condenser and alternately supplying the refrigerant to the first cycle and the second cycle independently such that the refrigerant does not pass through the first evaporator and the second evaporator simultaneously;

a first blowing fan disposed at one side of the first evaporator;

a second blowing fan disposed at one side of the second evaporator; and a heat exchanging device that performs heat exchange between the first and second evaporators, wherein the heat exchanging device includes a protrusion provided on the first evaporator, wherein the protrusion extends from the first evaporator into the refrigerating chamber to a position proximate the second evaporator such that the refrigerant remaining in the first evaporator is vaporized by a temperature difference between the first evaporator and the second evaporator, and wherein the protrusion comprises a pipe that extends from a part of an outlet of the first evaporator to the position proximate the second evaporator and back to the first evaporator such that the refrigerant remaining in the outlet of the first evaporator is vaporized by the temperature difference between the first and second evaporators and the refrigerant remaining in the first evaporator is collected to the compressor without a pump down operation to collect the refrigerant remaining in the first and second evaporators to the compressor in a state in which the refrigerant supply from the compressor to the first and second evaporators is blocked.

2. The refrigerating system of claim 1, wherein the protrusion is positioned near an outlet of the second evaporator.

3. A refrigerating system, comprising:

a refrigerant supply device provided downstream of a condenser and alternately supplying a refrigerant to a first cycle and to a second cycle independently such that the refrigerant does not pass through the first cycle and the second cycle simultaneously, the first cycle circulating the refrigerant discharged from a compressor through a first evaporator provided to cool a freezing chamber to maintain food items in a frozen state, and the second cycle circulating the refrigerant received from the refrigerant supply device through a second evaporator provided to cool a refrigerating chamber to maintain food items in a refrigerated state, the refrigerating chamber partitioned from the freezing chamber;

a first blowing fan disposed at one side of the first evaporator;

a second blowing fan disposed at one side of the second evaporator; and a heat exchanging device that performs heat exchange between the first and second evaporators, wherein the heat exchanging device includes a protrusion provided on the second evaporator, wherein the protrusion extends from an outlet of the second evaporator in the refrigerating chamber and into the freezing chamber so as to be positioned near the first evaporator such that the refrigerant remaining in the first evaporator is vaporized by a temperature difference between the first evaporator and the second evaporator, and collected to the compressor without a pump down operation to collect the refrigerant remaining in the first and second evaporators to the compressor in a state in which the refrigerant supply from the compressor to the first and second evaporators is blocked.

4. The refrigerating system of claim 3, wherein the protrusion is positioned near an outlet of the first evaporator.

5. The refrigerating system of claim 1, wherein the heat exchanging device is formed such that an outlet side refrigerant pipe of the second evaporator is wound around the first evaporator one or more times.

6. The refrigerating system of claim 5, wherein the refrigerant pipe of the second evaporator is wound around an outlet of the first evaporator one or more times.

7. The refrigerating system of claim 1, wherein the heat exchanging device is formed such that an outlet side refrigerant pipe of the second evaporator is wound around an outlet side refrigerant pipe of the first evaporator one or more times.

8. The refrigerating system of claim 1, wherein the heat exchanging device is formed such that an outlet side refrigerant pipe of the first evaporator is wound around the second evaporator one or more times.

9. The refrigerating system of claim 1, wherein the heat exchanging device is formed such that an outlet side refrigerant pipe of the first evaporator is wound around an outlet side refrigerant pipe of the second evaporator one or more times.

10. A refrigerator, comprising:

a refrigerator main body having a freezing chamber to maintain food items in a frozen state and a refrigerating chamber to maintain food items in a refrigerated state, the refrigerating chamber partitioned from the freezing chamber, a first evaporator disposed in the freezing chamber, that generates cooling air for the freezing chamber;

a second evaporator disposed in the refrigerating chamber, that generates cooling air for the refrigerating chamber;

a compressor disposed in the refrigerator main body to compress a refrigerant;

a first cycle to circulate the refrigerant discharged from the compressor via the first evaporator;

a second cycle to circulate the refrigerant discharged from the compressor via the second evaporator;

a refrigerant supply device positioned downstream of a condenser and independently connected to an inlet and an outlet of each of the first cycle and the second cycle to selectively introduce the refrigerant into the first cycle and the second cycle, such that the refrigerant does not pass through the first evaporator and the second evaporator simultaneously;

a first blowing fan disposed at one side of the first evaporator;

a second blowing fan disposed at one side of the second evaporator; and a heat exchange device having a protrusion that extends from an outlet of one of the first evaporator or the second evaporator to be received in a chamber in which the other of the first evaporator or the second evaporator is disposed, the protrusion comprising a pipe that extends from a part of the outlet of the one of the first evaporator or the second evaporator to the other of the first evaporator or the second evaporator and then back to the one of the first evaporator or the second evaporator such that the refrigerant flowing in the protrusion performs heat-exchange with the other of the first evaporator or the second evaporator such that the refrigerant remaining in the first evaporator is vaporized by a temperature difference between the first evaporator and the second evaporator and collected to the compressor without a pump down operation to collect the refrigerant remaining in the first and second evaporators to the compressor in a state in which the refrigerant supply from the compressor to the first and second evaporators is blocked.

11. The refrigerator of claim 10, wherein the protrusion comprises a first protruding portion formed by extending a part of the first evaporator, and wherein the first protruding portion is located adjacent to the second evaporator.

12. The refrigerator of claim 11, wherein the first protruding portion is located adjacent to the outlet of the second evaporator.

13. The refrigerator of claim 10, wherein the protrusion comprises a second protruding portion formed by extending a part of the second evaporator, and wherein the second protruding portion is located adjacent to the first evaporator.

14. The refrigerator of claim 13, wherein the second protruding portion is located adjacent to the outlet of the first evaporator.

* * * * *